US012577894B2

(12) United States Patent
Blackmur

(10) Patent No.: US 12,577,894 B2
(45) Date of Patent: Mar. 17, 2026

(54) VARIABLE CAMSHAFT TIMING ASSEMBLY WITH DEFORMABLE EXTENSION

(71) Applicant: BorgWarner, Inc., Auburn Hills, MI (US)

(72) Inventor: Shawn J. Blackmur, Brooktondale, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/077,084

(22) Filed: Oct. 22, 2020

(65) Prior Publication Data

US 2022/0127978 A1 Apr. 28, 2022

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01)

(58) Field of Classification Search
CPC ..... F01L 1/3442; F01L 1/047; F01L 1/344; F01L 1/34409; F01L 1/053; F01L 1/462; F01L 2001/34426; F01L 2001/34469; F01L 2820/043; F01L 2820/044; F01L 2820/01; F01L 2301/00
USPC ..... 123/90.15, 90.17
See application file for complete search history.

(56) References Cited

U.S. PATENT DOCUMENTS 3,913,785 A * 10/1975 Pattershall ..... B44D 3/127 206/508
6,457,532 B1 10/2002 Simpson
8,915,222 B2 * 12/2014 Kobayashi ..... F01L 1/3442 123/90.15
10,247,057 B2 * 4/2019 Boese ..... F01L 1/3442
11,473,454 B2 * 10/2022 Brand ..... F01L 1/3442
2004/0221826 A1 * 11/2004 Knecht ..... F01L 1/022 123/90.15
2005/0115526 A1 * 6/2005 Schneider ..... F01L 1/3442 123/90.17
2014/0123920 A1 * 5/2014 Lichti ..... F01L 1/344 123/90.15
2015/0007800 A1 * 1/2015 Wade ..... F02B 37/18 123/568.14
2016/0003110 A1 * 1/2016 Brenner ..... F01L 1/3442 123/90.15

(Continued)

FOREIGN PATENT DOCUMENTS

DE 202020104168 U1 9/2020

OTHER PUBLICATIONS

Chinese Office Action for Chinese Application No. 202111221359.8 dated Aug. 3, 2023 (8 pages).

(Continued)

*Primary Examiner* — Mark A Laurenzi
*Assistant Examiner* — Kelsey L Stanek
(74) *Attorney, Agent, or Firm* — Reising Ethington P.C.

(57) ABSTRACT

A variable camshaft timing (VCT) assembly includes a rotor having a hub from which one or more vanes extend radially outwardly; and a stator having a stator cavity that receives the rotor and permits the rotor to rotate relative to the stator about an axis of rotation, wherein the stator includes a deformable extension that regulates a distance between the stator and another component of the VCT assembly.

12 Claims, 4 Drawing Sheets

(56) References Cited

U.S. PATENT DOCUMENTS

2018/0355767 A1* 12/2018 Boese ..... F01L 1/24
2022/0333511 A1* 10/2022 Brand ..... B23K 26/21

OTHER PUBLICATIONS

English Translation of Chinese Office Action for Chinese Application No. 202111221359.8 dated Aug. 3, 2023 (14 pages).
CN Office Action for CN Application No. 202111221359.8 dated Jan. 6, 2024 (17 pages).

* cited by examiner

VARIABLE CAMSHAFT TIMING ASSEMBLY WITH DEFORMABLE EXTENSION

TECHNICAL FIELD

The present application relates to variable camshaft timing (VCT) assemblies and, more particularly, to deformable features on at least a portion of a VCT assembly.

BACKGROUND

Internal Combustion Engines (ICEs) include one or more camshafts that open and close intake/exhaust valves and are rotationally driven by a crankshaft via an endless loop, such as a chain. The camshafts have shaped lobes that open and close valves as the camshafts are rotated. The opening and closing of the valves is precisely controlled based on the angular position of the camshaft(s) relative to the angular position of the crankshaft. In the past, the angular position of the crankshaft was fixed relative to the angular position of the camshaft(s). However, the ability to change the angular position of the camshaft relative to the angular position of the crankshaft such that ignition timing is advanced or retarded can help increase engine performance in a variety of ways, such as by improving engine smoothness at low-operating temperatures or by increasing fuel efficiency. The ability of change the angular position of the camshaft relative to the angular position of the crankshaft is often referred to as variable camshaft timing (VCT).

VCT can be implemented in a variety of ways. For example, VCT can be implemented using devices such as camshaft phasers that are actuated electrically or hydraulically. With respect to hydraulically-actuated camshaft phasers, a stator receives a rotor having one or more vanes and the rotor rotates relative to the stator. The stator can include a camshaft sprocket that engages the endless loop and communicates rotational energy from a crankshaft sprocket that also engages the endless loop. The vane(s) can be received by chamber(s) formed in the stator so that a radially-outward end of the vane abuts a radially-inward facing surface of the chamber to divide the chamber(s) into an advancing chamber section and a retarding chamber section. Supplying fluid, such as engine oil, to one chamber section while permitting fluid to exit another chamber section can move the rotor in one angular direction relative to the stator. Various mechanisms exist for supplying this fluid. Creating and maintaining clearances between different components of the camshaft phaser help ensure that the phaser properly functions. For example, ensuring that proper tolerances exist between the rotor and the stator or the rotor and a cover can permit fluid to flow within an intended space and prevent binding of the rotor relative to the stator. However, creating these tolerances can involve significant resources.

SUMMARY

In one implementation, a variable camshaft timing (VCT) assembly includes a rotor having a hub from which one or more vanes extend radially outwardly; and a stator having a stator cavity that receives the rotor and permits the rotor to rotate relative to the stator about an axis of rotation, wherein the stator includes a deformable extension that regulates a distance between the stator and another component of the VCT assembly.

In another implementation, a variable camshaft timing (VCT) assembly includes a rotor having a hub from which one or more vanes extend radially outwardly; a stator having a stator cavity that receives the rotor and permits the rotor to rotate relative to the stator about an axis of rotation, wherein the stator includes a deformable extension that regulates a distance between the stator and another component of the VCT assembly and an end plate extension that is configured to be mechanically deformed to join an end plate to the stator.

DETAILED DESCRIPTION

A variable camshaft timing (VCT) assembly, such as a camshaft phaser, can have a stator formed from a substrate that includes a deformable extension regulating a distance between the stator and another component of the assembly. The VCT assembly can be assembled from a rotor, the stator, and end plates, for instance. The distance or tolerances between these elements can be specified and controlled using a deformable extension located on the stator. As the stator is manufactured, the deformable extension can be created as part of the initial casting of the part. Later, the size of the deformable extension can be mechanically altered based on a tolerance value to control the distance between the stator and other elements of the VCT assembly, such as an axial face of the rotor, the end plate, or both. In the past, the stator and other elements of the VCT assembly have been manufactured and later machined to more carefully control the dimensions of the stator and other elements. But subsequent machining of VCT assembly parts involves time and expense and use of the deformable extension can reduce or eliminate machine processing of VCT assembly parts. Another, different part of the stator can also be mechanically deformed so as to cabin the end plate in between the stator and the deformable extension thereby creating a mechanical connection or joint between these elements. The term stator, included here in the specification, can be interpreted to include any component of the VCT assembly having the deformable extension and should not be limited to embodiments disclosed herein.

Figure 1:
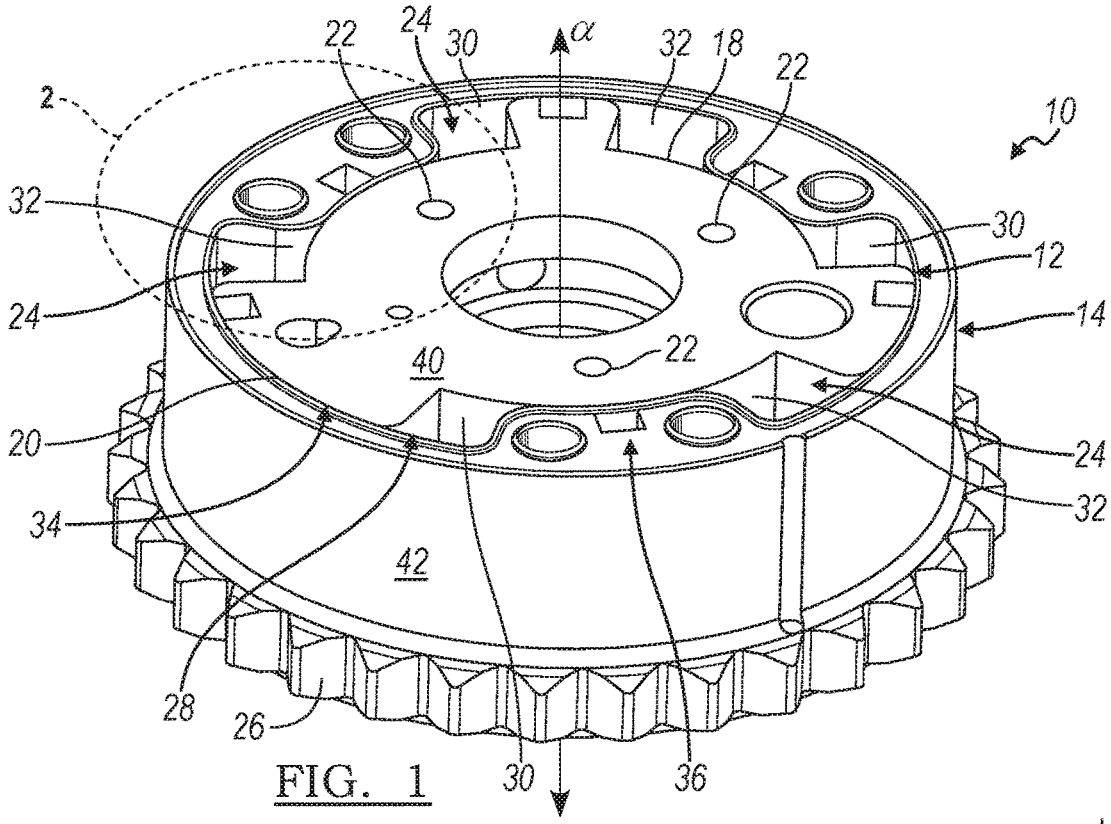
FIG. 1 is a perspective view depicting an implementation of a variable camshaft timing (VCT) assembly.
Figure 2:
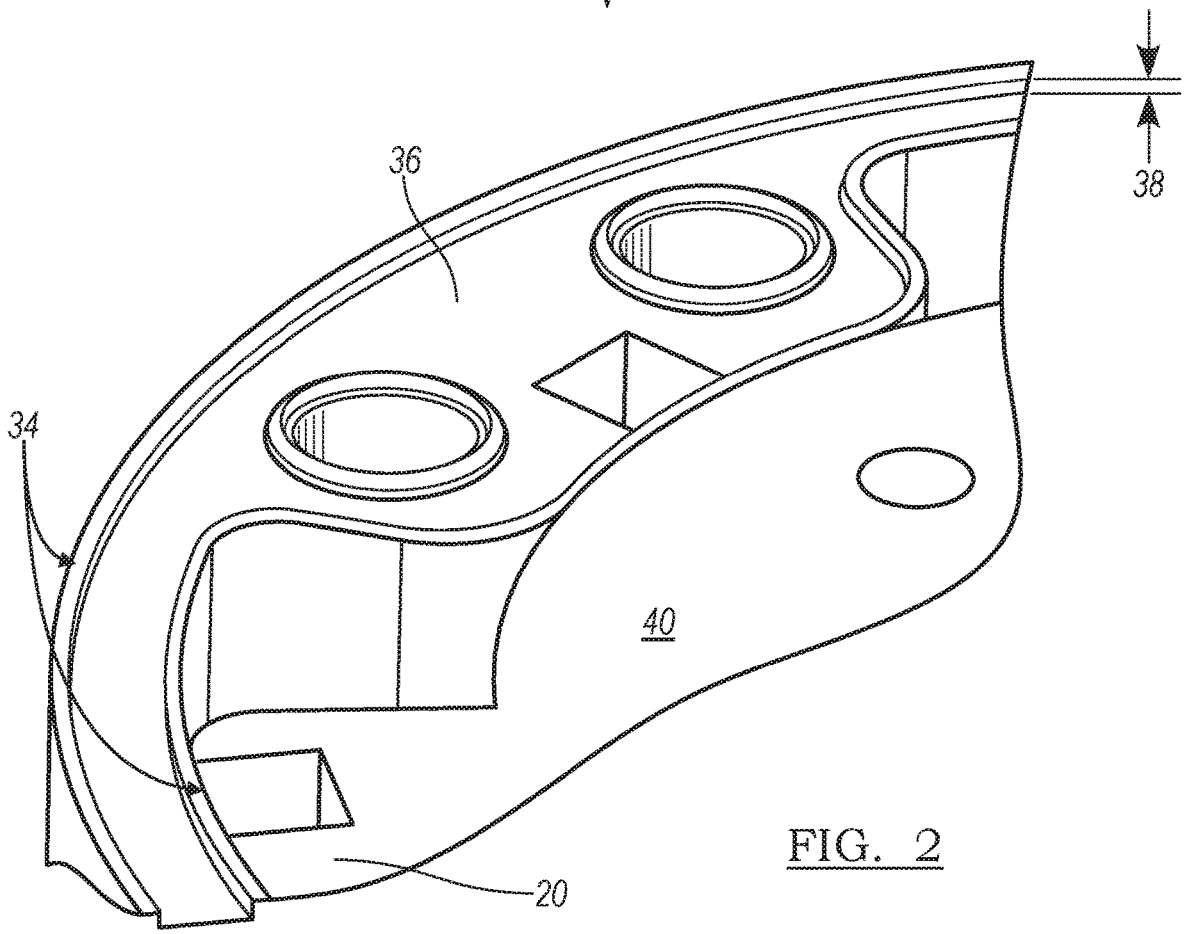
FIG. 2 is a perspective view depicting a portion of an implementation of the VCT assembly.

An implementation of a VCT assembly in the form of a hydraulically-controlled camshaft phaser 10 is shown in FIGS. 1-2. An example of a hydraulically-controlled camshaft phaser is described in U.S. Pat. No. 8,356,583, the contents of which are hereby incorporated by reference. The phaser 10 includes a rotor 12, a stator 14, and an end plate 16. The rotor 12 has a hub 18 with vanes 20 that extend radially outwardly away from the hub 18 and an axis of rotation (x). Apart from the vanes 20, the rotor 12 can include one or more fluid passages 22 for communicating fluid toward and away from fluid chambers 24 as well as with a fluid supply and a fluid tank (not shown). The hub 18 can be rigidly coupled to a distal end of a camshaft in a way that the rotor 12 and the camshaft are not angularly displaced relative to each other.

The stator 14 can include a camshaft sprocket 26 on a radially-outer surface of the stator 14. The camshaft sprocket 26 can engage an endless loop, such as a chain, that also engages a crankshaft sprocket that transmits rotational force from the crankshaft to the stator 14. The rotor 12 can be positioned within the stator 14 to rotate relative to the stator 14 and angularly displace the rotor 12 relative to the stator 14 and change the phase of the camshaft relative to the crankshaft. The rotor 12 can be received within a stator cavity 28 formed within the stator 14 such that the vanes 20 extend into fluid chambers 24 formed within the stator cavity 28. The fluid chambers 24 are located radially-outwardly from the hub 18 such that each vane 20 can divide the fluid chamber 24 into an advancing chamber portion 30 and a retarding chamber portion 32. The rotor 12 can rotate about the axis of rotation (x) within the stator cavity 28 in response to fluid supplied to or exiting from the advancing or retarding chamber portions 30, 32 thereby changing the angular position of the camshaft relative to the angular position of the stator 14.

The stator 14 can be formed from a substrate in a mold to create an initial form that includes a deformable extension 34. The deformable extension 34 in this implementation can extend from an axial face of the stator 36 along the axis of rotation (x). The deformable extension 34 can create or define an axial distance 40 between the axial face of the stator 36 and an axial face of the rotor 40. The deformable extension 34 can create or define an axial distance between the axial face of the stator 36 and the end plate 16. In this implementation, the deformable extension 34 can follow a portion of the axial face of the stator 36 along the radially-outer surface of the stator 42 as well as following the contour of the fluid chambers 24. The stator 14 can be formed using a mold that includes the deformable extension 34 as part of the initial shape of the stator 14. In one implementation, powdered metal can be filled in the mold that includes the deformable extension 34. After applying heat to the powdered metal in the mold, the stator 14 can emerge from the mold as a metal substrate. In other implementations, a metal or metal alloy can be heated to a temperature at which it exists in a molten state and then applied to the mold. After cooling, the formed stator 14 can be removed from the mold.

After emerging from the mold, the deformable extension 34 exists at an initial axial length extending along the axis of rotation (x). The initial axial length may be the largest axial length. Depending on a desired distance between the stator 14 and other elements of the VCT assembly 10, force can be applied to the deformable extension 34 in a direction at least substantially toward the axial face of the stator 36 to reduce the axial length of the deformable extension 34. The amount and/or duration of the force can depend on the amount of change in axial length of the deformable extension 34 desired. In one implementation, the application of force on the deformable extension 34 can be accomplished using metal roll-forming techniques. After application of force on the deformable extension 34, a final axial length can be created. The length or magnitude of the deformable extension 34 at the final axial length can define the relative position of the axial face of the stator relative to the axial face of the rotor. The length or magnitude of the deformable extension 34 at the final axial length can also define the clearance between the end plate 16 and the axial face of the rotor 40.

The end plate 16 (shown in FIGS. 3-4) can be formed as a flange or planar disk that directly abuts the deformable extension 34 existing at its final axial length. An aperture 44 can be formed and sized such that a camshaft can pass through the aperture 44 and couple with the rotor 12. The end plate 16 can be coupled to the stator shown in FIGS. 1-2 with mechanical fasteners, such as bolts that fit into threaded receivers formed in the stator 14. The end plate 16 can be pressed against the stator 14 and the deformable portion 34 thereby creating a fluid-tight seal with the application of torque to the fasteners.

Figure 3A:
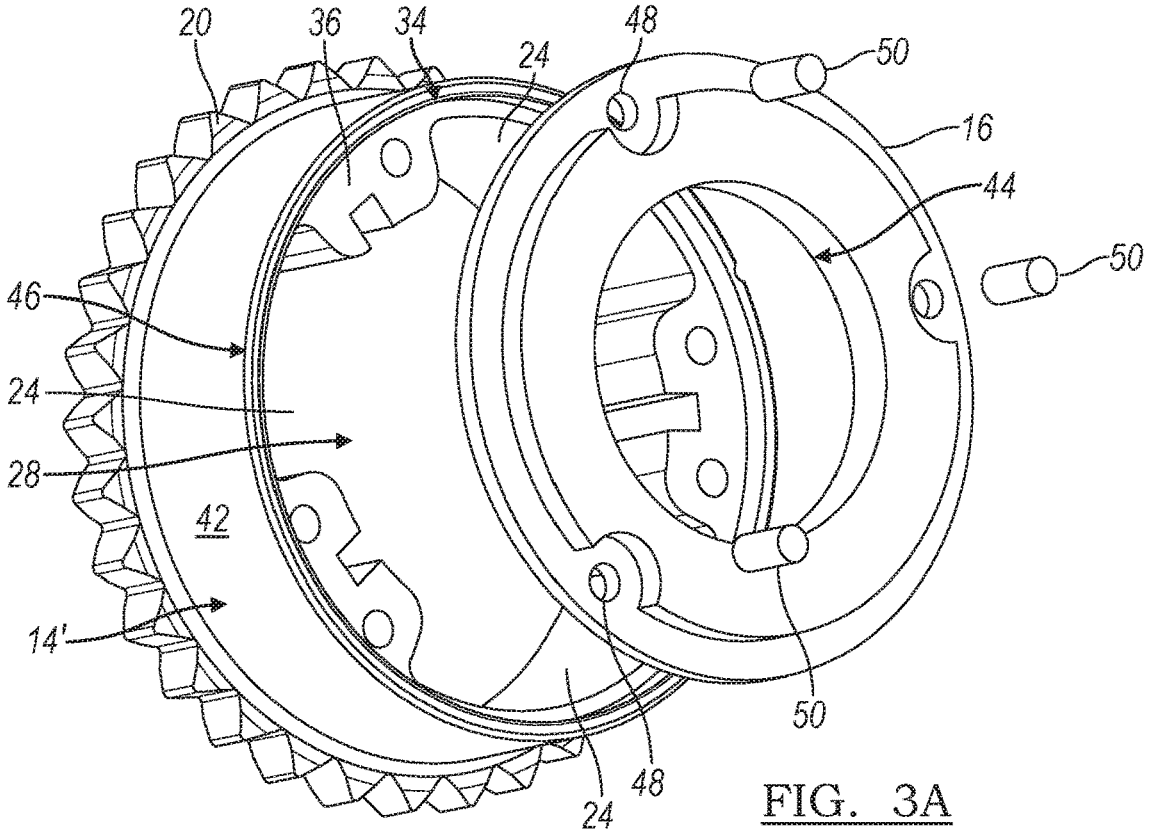
FIG. 3*a* is an exploded view depicting an implementation of an implementation of the VCT assembly.
Figure 3B:
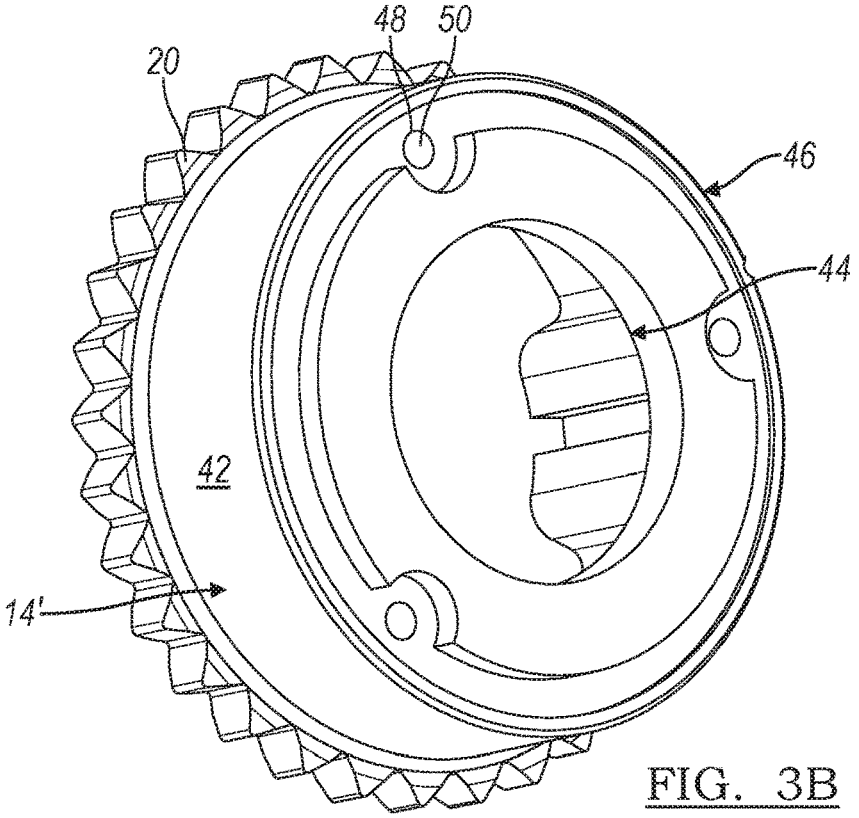
FIG. 3*b* is a perspective view depicting an implementation of the VCT assembly.
Figure 4:
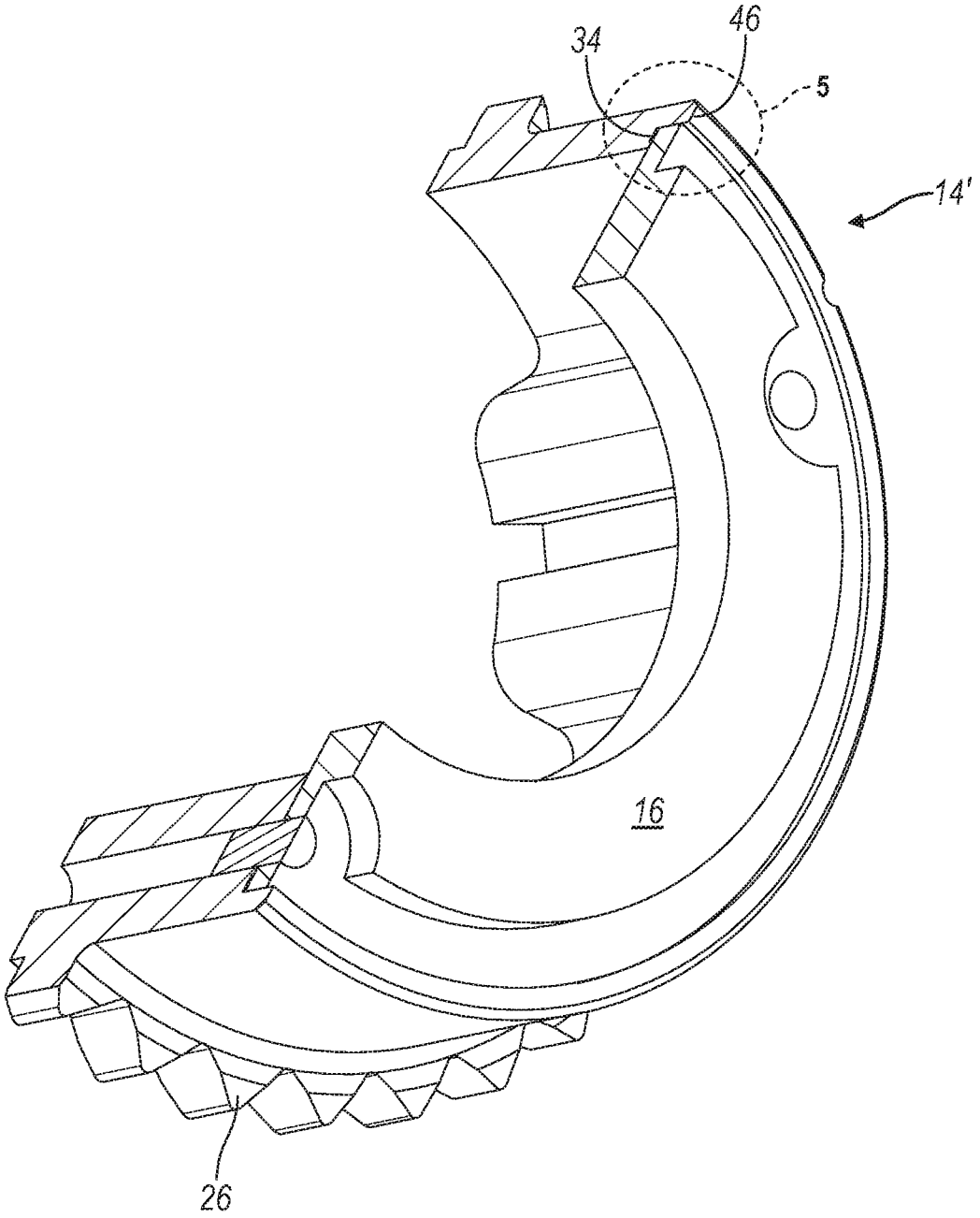
FIG. 4 is a cross-sectional view depicting an implementation of the VCT assembly.

Another implementation of a VCT assembly in the form of a hydraulically-controlled camshaft phaser 100 is shown in FIGS. 3-5. The phaser 100 includes the rotor 12, the stator 14', and the end plate 16. The rotor 12 and end plate 16 can be implemented as described above. The rotor 12 can be received within the stator cavity 28 formed within the stator 14' such that the vanes 20 extend into fluid chambers 24 formed within the stator cavity 28. The fluid chambers 24 can positioned radially-outwardly from the hub 18 such that each vane 20 can divide the fluid chamber 24 into an advancing chamber portion 30 and a retarding chamber portion 32.

The stator 14' can be formed from a substrate in a mold to create an initial form that includes a deformable extension 34 and an end plate extension 46. The deformable extension 34 in this implementation can extend from the axial face of the stator 36 along the axis of rotation (x). The deformable extension 34 can create or define an axial distance 38 between the axial face of the stator 36 and an axial face of the rotor 40. The deformable extension 34 can create or define an axial distance between the axial face of the stator 14' and an end plate 16. In this implementation, the deformable extension 34 can follow a portion of the axial face of the stator 36 along the radially-outer surface of the stator 42. In addition to the deformable extension 34, the stator 14' can be formed with the end plate extension 46 that is later mechanically deformed to secure the end plate 16 to the stator 14'. The stator 14' and the end plate 16 can include apertures 48 through which studs 50 can extend thereby preventing the rotation of the stator 14' relative to the end plate 16.

Figure 5A:
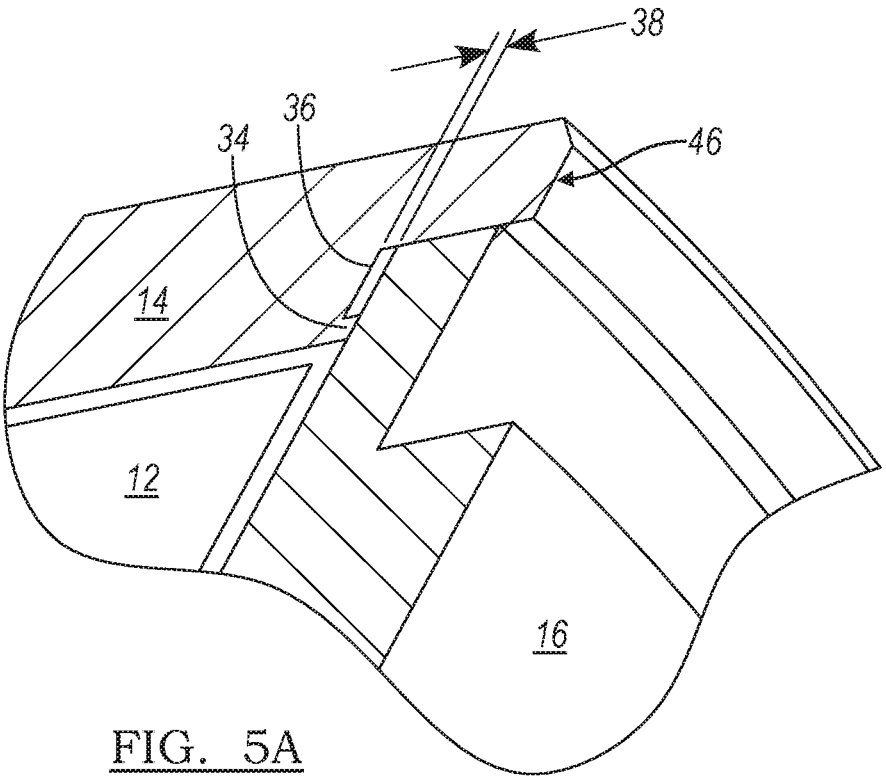
FIG. 5*a* is another cross-sectional view depicting an implementation of the VCT assembly.
Figure 5B:
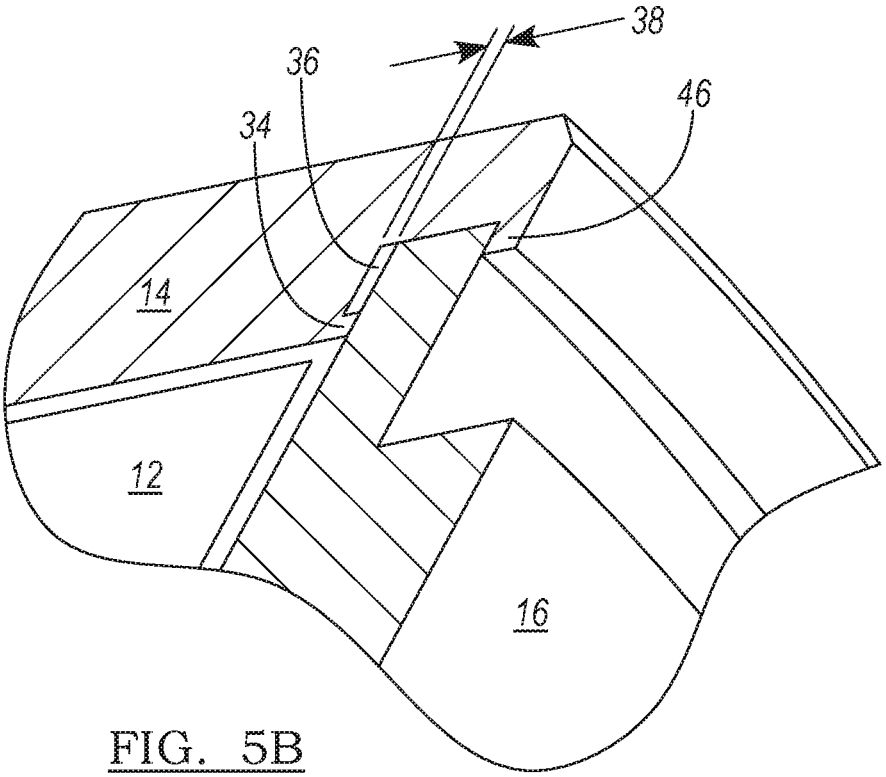
FIG. 5*b* is another cross-sectional view depicting an implementation of the VCT assembly.

The end plate extension 46 can be mechanically deformed to connect the end plate 16 to the stator 14'. FIG. 5*a* depicts a portion of the end plate 16 in abutment with the stator 14' and the end plate extension 46 in an initial state before mechanical deformation. And FIG. 5*b* depicts the end plate extension 46 in a final state after mechanical deformation to couple the end plate 16 to the stator 14'. The deformable extension 34 can be positioned on one side of the end plate 16 such that it can support that side of the end plate 16 while the end plate extension 46 is mechanically deformed on another side of the end plate 16 to force the end plate 16 toward the deformable extension 46 and the stator 14'. The mechanical deformation can be accomplished using roll-forming or other similar techniques.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) assembly comprising:

a rotor having a hub from which one or more vanes extend radially outwardly; and a stator having a stator cavity that receives the rotor and permits the rotor to rotate relative to the stator about an axis of rotation, a deformable extension, included as part of the stator without any separation from the stator, that is configured to be mechanically-altered as to size based on a tolerance value wherein the tolerance value specifies a desired distance between the stator and another component of the VCT assembly, the deformable extension being configured to regulate the distance.

2. The VCT assembly recited in claim 1, wherein the deformable extension extends from an axial face of the stator.

3. The VCT assembly recited in claim 1, wherein the VCT assembly is a hydraulically-actuated camshaft phaser.

4. The VCT assembly recited in claim 1, further comprising an end plate coupled with the stator via a mechanically-deformed end plate extension.

5. The VCT assembly recited in claim 1, further comprising an end plate coupled with the stator via one or more mechanical fasteners.

6. The VCT assembly recited in claim 1, wherein the rotor is configured to couple with a camshaft.

7. A variable camshaft timing (VCT) assembly comprising:

a rotor having a hub from which one or more vanes extend radially outwardly;

a stator having a stator cavity that receives the rotor and permits the rotor to rotate relative to the stator about an axis of rotation, wherein the stator is monolithic and includes a deformable extension, included as part of the stator without any separation from the stator, that is configured to be mechanically-altered as to size based on a tolerance value wherein the tolerance value specifies a desired distance between the stator and another component of the VCT assembly, the deformable extension being configured to regulate the distance, and an end plate extension that is configured to be mechanically deformed to join an end plate to the stator.

8. The VCT assembly recited in claim 7, wherein the deformable extension extends from an axial face of the stator.

9. The VCT assembly recited in claim 7, wherein the end plate extension extends from an axial face of the stator.

10. The VCT assembly recited in claim 7, wherein the VCT assembly is a hydraulically-actuated camshaft phaser.

11. The VCT assembly recited in claim 7, further comprising the end plate coupled with the stator via the end plate extension.

12. The VCT assembly recited in claim 7, wherein the rotor is configured to couple with a camshaft.

* * * * *